US010424887B2

(12) United States Patent
Hirschman et al.

(10) Patent No.: US 10,424,887 B2
(45) Date of Patent: Sep. 24, 2019

(54) HYBRID POWER DELIVERY ASSEMBLY

(71) Applicant: Arista Networks, Inc., Santa Clara, CA (US)

(72) Inventors: Jeffrey Hirschman, Santa Clara, CA (US); Matthew Gawlowski, Santa Clara, CA (US); Youngbae Park, Santa Clara, CA (US); Duong Lu, Santa Clara, CA (US); Alex Rose, Santa Clara, CA (US); Robert Wilcox, Santa Clara, CA (US); Richard Hibbs, Santa Clara, CA (US)

(73) Assignee: ARISTA NETWORKS, INC., Santa Clara, CA (US)

( * ) Notice: Subject to any disclaimer, the term of this patent is extended or adjusted under 35 U.S.C. 154(b) by 0 days.

(21) Appl. No.: 15/477,751

(22) Filed: Apr. 3, 2017

(65) Prior Publication Data

US 2018/0287318 A1 Oct. 4, 2018

(51) Int. Cl.

| | |
|---|---|
| ***H01R 25/00*** | (2006.01) |
| ***H01R 25/16*** | (2006.01) |
| ***H01R 13/66*** | (2006.01) |
| ***H01R 12/72*** | (2011.01) |
| ***H01R 12/70*** | (2011.01) |

(52) U.S. Cl.

CPC ..... *H01R 25/162* (2013.01); *H01R 12/7088* (2013.01); *H01R 12/724* (2013.01); *H01R 13/665* (2013.01)

(58) Field of Classification Search

CPC .... H01R 25/162; H01R 12/716; H01R 12/57; H01R 12/58; H01R 13/6658; H01R 12/7088

See application file for complete search history.

(56) References Cited

U.S. PATENT DOCUMENTS

| | | | | |
|---|---|---|---|---|
| 4,878,862 | A * | 11/1989 | Wise | H01R 25/162 29/876 |
| 6,848,950 | B2 * | 2/2005 | Allison | H01R 12/75 439/682 |
| 8,057,266 | B1 * | 11/2011 | Roitberg | H01R 13/055 439/682 |
| 8,388,389 | B2 | 3/2013 | Costello et al. | |
| 8,641,432 | B2 * | 2/2014 | Northey | G09B 19/00 439/110 |
| 9,153,887 | B2 * | 10/2015 | Chen | H01R 12/7088 |
| 2008/0299838 | A1 | 12/2008 | Kopp | |
| 2009/0047814 | A1 | 2/2009 | Daamen | |

(Continued)

OTHER PUBLICATIONS

PCT/US2018/025873 International Search Report and Written Opinion, dated Jul. 20, 2018, (11 pages).

*Primary Examiner* — Xuong M Chung Trans

(74) *Attorney, Agent, or Firm* — Womble Bond Dickinson (US) LLP

(57) ABSTRACT

A busbar and connector assembly is provided. The busbar and connector assembly includes a printed circuit board having an attached connector arranged to couple to a first busbar and a second busbar coupled to the connector. The busbar and connector assembly includes the connector arranged to distribute a first portion of current from the first busbar to the printed circuit board and distribute a second portion of the current from the first busbar to the second busbar.

21 Claims, 3 Drawing Sheets

(56) References Cited

U.S. PATENT DOCUMENTS

| | | | | |
|---|---|---|---|---|
| 2010/0304583 | A1* | 12/2010 | Busse | H04Q 1/142<br>439/76.1 |
| 2015/0009607 | A1 | 1/2015 | Daamen et al. | |
| 2015/0364878 | A1 | 12/2015 | Orris | |

* cited by examiner

HYBRID POWER DELIVERY ASSEMBLY

BACKGROUND

High levels of current and short-circuits in printed circuit boards can destroy the printed circuit boards and even lead to fires. Network switches, line cards and other electronic circuits drawing tens of amperes of current, or even hundreds of amperes, are vulnerable to small defects in circuit board construction or materials. Printed circuit boards need thicker sheets of copper, more layers, or more exotic and expensive materials to safely handle these high current levels. Large amperage fuses may be bulky, unavailable, or fail to protect from fires caused by the large current levels experienced by the printed circuit board even prior to the current reaching the fuse. Printed circuit boards are burdened with having to have enough copper layers to carry the complete current, which can consume many layers of copper that increase cost and increase routing complexity. In addition current levels are so high, there is increased risk of the PCB failing causing a short and a fire.

SUMMARY

In some embodiments, a busbar and connector assembly is provided. The busbar and connector assembly includes a printed circuit board having an attached connector arranged to couple to a first busbar and a second busbar coupled to the connector. The busbar and connector assembly includes the connector arranged to distribute a first portion of current from the first busbar to the printed circuit board and distribute a second portion of the current from the first busbar to the second busbar. It should be appreciated that the embodiments enable the complete or partial bypass of the printed circuit board to connect to a secondary or external busbar, thereby reducing or removing the need for the printed circuit board to carry part or all of the current.

In some embodiments, a busbar and connector assembly is provided. The busbar and connector assembly includes a first busbar, arranged to carry a first current, a printed circuit board, and a second busbar. The connector is arranged to deliver a second current from the first busbar to the printed circuit board and deliver a third current from the first busbar to the second busbar.

In some embodiments, a method of distributing current through a printed circuit board, busbar and connector assembly is provided. The method includes passing the current through a first busbar and distributing a first portion of the current from the first busbar through a connector, to a printed circuit board. The method includes distributing a second portion of the current from the first busbar through the connector, to a second busbar.

Other aspects and advantages of the embodiments will become apparent from the following detailed description taken in conjunction with the accompanying drawings which illustrate, by way of example, the principles of the described embodiments.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION

A printed circuit board, busbar and connector assembly described herein solves multiple problems for current distribution in an electronic system. Embodiments of the electronic system may include network switches, but are readily devised for other types of electronic equipment. A connector couples two different busbars and a printed circuit board, and distributes current from one busbar to the printed circuit board and the other busbar. In a rack-mounted or modular system, multiple examples of printed circuit boards with such connectors can plug into busbars in a backplane or mid-plane, and distribute current to the printed circuit boards and busbars for use by various components of the electronic system. This improves upon the use of printed circuit boards to distribute all of the current from a backplane or mid-plane to all of the components of the electronic system, and allows the connectors to drop current down to the printed circuit boards as needed while allowing additional current to travel through busbars bypassing the circuit boards on the way to other components. Also, with the connector delivering just the correct amount of current used locally by the printed circuit board, rather than all of the current for the printed circuit board and further downstream components, fewer holes need be drilled through the printed circuit board for connector pins, reducing the "Swiss cheese" effect on printed circuit board power (and other) layers. The embodiments reduce the number of feeds inside the printed circuit board and move at least a portion of the feeds to busbars, thereby reducing the amount of "unfused copper" to improving safety and recover printed circuit board resources. In addition, the embodiments have fuses that can now be correctly sized for the current used by the components on the printed circuit board near the connector, instead of being oversized for that area of the printed circuit board plus the downstream component current.

Figure 1:
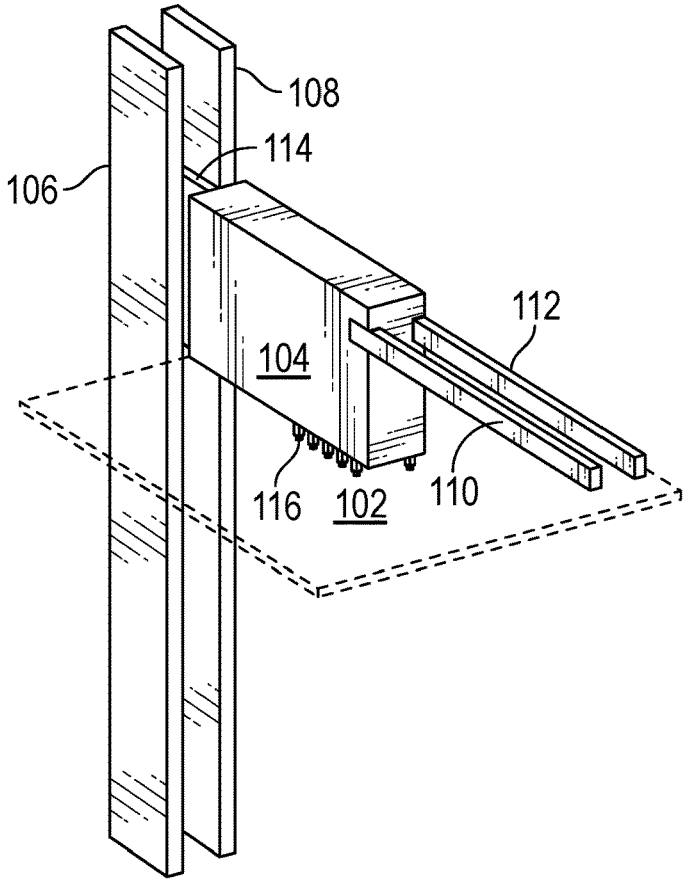
FIG. 1 is a perspective view of a printed circuit board, busbar and connector assembly in accordance with some embodiments.
Figure 2:
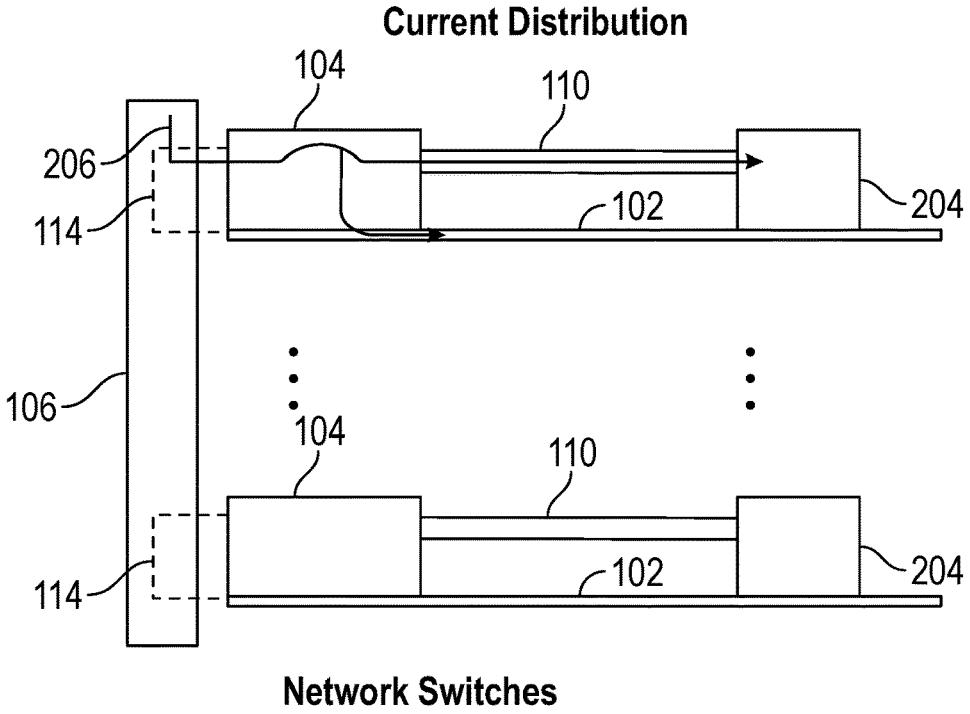
FIG. 2 is a side view showing current distribution and members of a printed circuit board, busbar and connector assembly, in accordance with some embodiments.

FIG. 1 is a perspective view of a printed circuit board, busbar and connector assembly in accordance with the present disclosure. Although only one connector 104 and one printed circuit board 102 (in dashed line) are shown here, further embodiments can have multiple connectors 104 and/or multiple printed circuit boards 102, for example as shown in FIG. 2. A connector tip 114 of the connector 104 is positioned between two busbars 106, 108, for example running vertically as shown in FIG. 1. Pins 116 of the connector 104 are assembled to the printed circuit board 102, for example by soldering or some other mechanism. Two additional busbars 110, 112 extend from and are electrically coupled to the connector (for example, see FIG. 4). In various embodiments, various electronic components are assembled to the printed circuit board 102 and draw power through the connector 104. One or more further electronic components are connected to the busbars 110, 112 and draw power through the busbars 110, 112. As illustrated busbars 110 and 112 are external and spaced apart from printed circuit board 102.

FIG. 1 shows one arrangement of a printed circuit board, busbar and connector assembly, and it should be appreciated that many variations are possible. In some embodiments, the busbars 106, 108 extend along a backplane or mid-plane, for example of a rack mounted system or a modular system. The busbars 106, 108 could be held in a spaced apart arrangement by clips, brackets, spacers, clamps, etc., in some embodiments In some systems, the busbars 106, 108 form balanced power and ground, as do the busbars 110, 112. Further busbars could be added, for additional power supply voltages, supplies for analog versus digital circuitry, etc. In some systems, ground is distributed through multiple ground planes in the printed circuit board and power is distributed through the connector from a busbar to the printed circuit board, rather than through power and ground balanced busbars. While FIG. 1 illustrates two busbars 110 and 112 extending from connector 104, it should be appreciated that one or more busbars may extend from connector 104, external to printed circuit board 102, depending on the application.

FIG. 2 is a side view showing current distribution and one example structural configuration of a printed circuit board, busbar and connector assembly, in an embodiment for rack mounted or modular network switches. Each printed circuit board 102 has electronic circuits for one or more network switches, although other electronic circuitry for alternative functionality is readily usable in further embodiments. The printed circuit boards 102 are coupled into the backplane or mid-plane in some embodiments. Details of the hardware, enclosures, faceplates, cables, etc., are omitted so as not to obscure details of the presently disclosed mechanisms. As noted above, while one example is provided as a network switch, this example is not meant to be limiting as the embodiments can be extended to any suitable electronic device.

Still referring to FIG. 2, electrical current 206 flows through the busbar 106, through the connector tip 114 and to the connector 104. The current is then split, with some of the current flowing into the distribution layers of the printed circuit board 102, and some of the current flowing on into and through the busbar 110, to another component 204 (or to another part of the printed circuit board 102). For example, the component 204 could be an optical module, a fan arranged to cool the printed circuit board, a front panel, etc. It should be appreciated that busbars 110 and 112 may be coupled to a component not attached to the printed circuit board 102 in some embodiments. Component 204 may be another connector in some embodiments and may carry current from busbars 110 and 112 into the printed circuit board 102 where the current will then enter a fuse. In some embodiments, the amount of current that flows through the connector 104 to the printed circuit board 102 is less than the amount of current that flows through the busbar 110 to further circuitry or component(s). It should be appreciated that description of current is generic with regard to conventions of positive or negative current in this context, not specific with regard to polarity of charge carriers. As illustrated, busbar 110 is external to and spaced apart from printed circuit board 102. Thus, busbar 110 can be configured to accommodate a large current without consideration of the limitations placed on the thickness of the power and ground layers of the printed circuit board 102.

Figure 3:
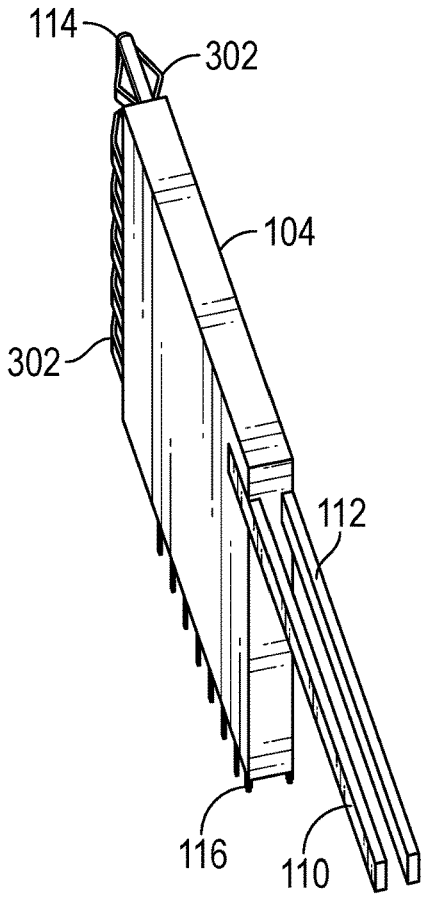
FIG. 3 is a perspective view of a connector and busbars, suitable for use in embodiments shown in FIGS. 1 and 2.

FIG. 3 is a perspective view of a connector 104 and busbars 110, 112, suitable for use in embodiments shown in FIGS. 1 and 2. Both sides of the connector tip 114 have fingers 302 extending therefrom. For example fingers 302 on one side of the connector tip 114 may contact a ground busbar, and fingers 302 on an opposing side of the connector tip 114 may contact a power busbar. The fingers 302 are spring mounted so that the connector tip 114 can be pressed between the busbars 106, 108 and float relative to the busbars 106, 108 in some embodiments. It should be appreciated that this configuration provides an electrical contact without the need for rigidly mounting the connector 104 to the busbars 106, 108 or vice versa. This floating arrangement also gives the busbar and connector assembly physical shock resistance in the field. Alternative embodiments for the connector may have other types of mountings for the connector and one or more busbars, specific to the needs of the system.

Continuing with FIG. 3, pins 116 of the connector 104 could be grouped in various ways, with some of the pins 116 providing a ground connection from one of the busbars 108, and other pins 116 providing a power connection from the other busbar 106. Alternatively, all of the pins 116 could be dedicated to the power connection, in versions where ground is routed from the backplane directly through the ground planes of the printed circuit board and not through the connector 104. Further variations, with various power supply polarities and multiple power supplies, etc., are readily devised. Busbars 110, 112 extending from the connector 104, external to a printed circuit board, could be of various lengths, parallel to each other, aligned or staggered, or diverging from the connector 104, etc. Some embodiments have one busbar 110 attached to the connector 104, while other embodiments may have more than two busbars attached to the connector 104. The end of the busbars 110, 112 distal to the connector 104 may attach to a component, or elsewhere on the printed circuit board, or to another printed circuit board or connector, etc., in various embodiments. Busbars 110, 112 may be composed of copper or some other suitable conductive material. As busbars 110, 112 are external to the printed circuit board, the thickness and composition of the busbars is independent of the printed circuit board.

Figure 4:
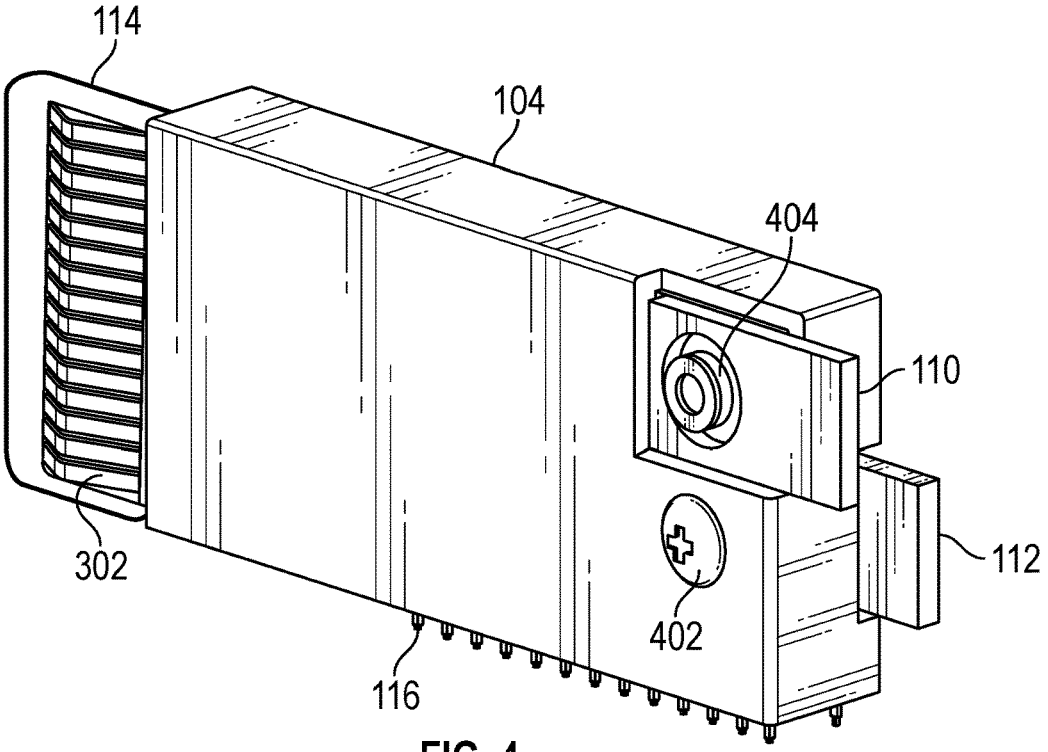
FIG. 4 is a perspective view of a connector with truncated busbars, showing details of fasteners for busbars, and fingers for a connector tip in accordance with some embodiments.

FIG. 4 is a perspective view of a connector 104 with truncated busbars 110, 112, showing details of fasteners 402, 404 for busbars 110, 112, and fingers 302 for a connector tip 114. One busbar 110 is fastened to the connector 104 with a nut 404 and bolt (not shown), the other busbar 110 is fastened or affixed to the connector 104 with a bolt 402 and a nut (not shown), although many other types of fasteners could be used, as could soldering, welding or other means readily devised. In the embodiment shown, the fingers 302 have an arched shape and cantilever support at the body of the connector 104, although other shapes, types of fingers, electrically connecting surfaces and mechanical arrangements for connection are readily devised. Further details on the connector 104 may be found in U.S. application Ser. No. 15/346,407, which is incorporated by reference for all purposes.

Figure 5:
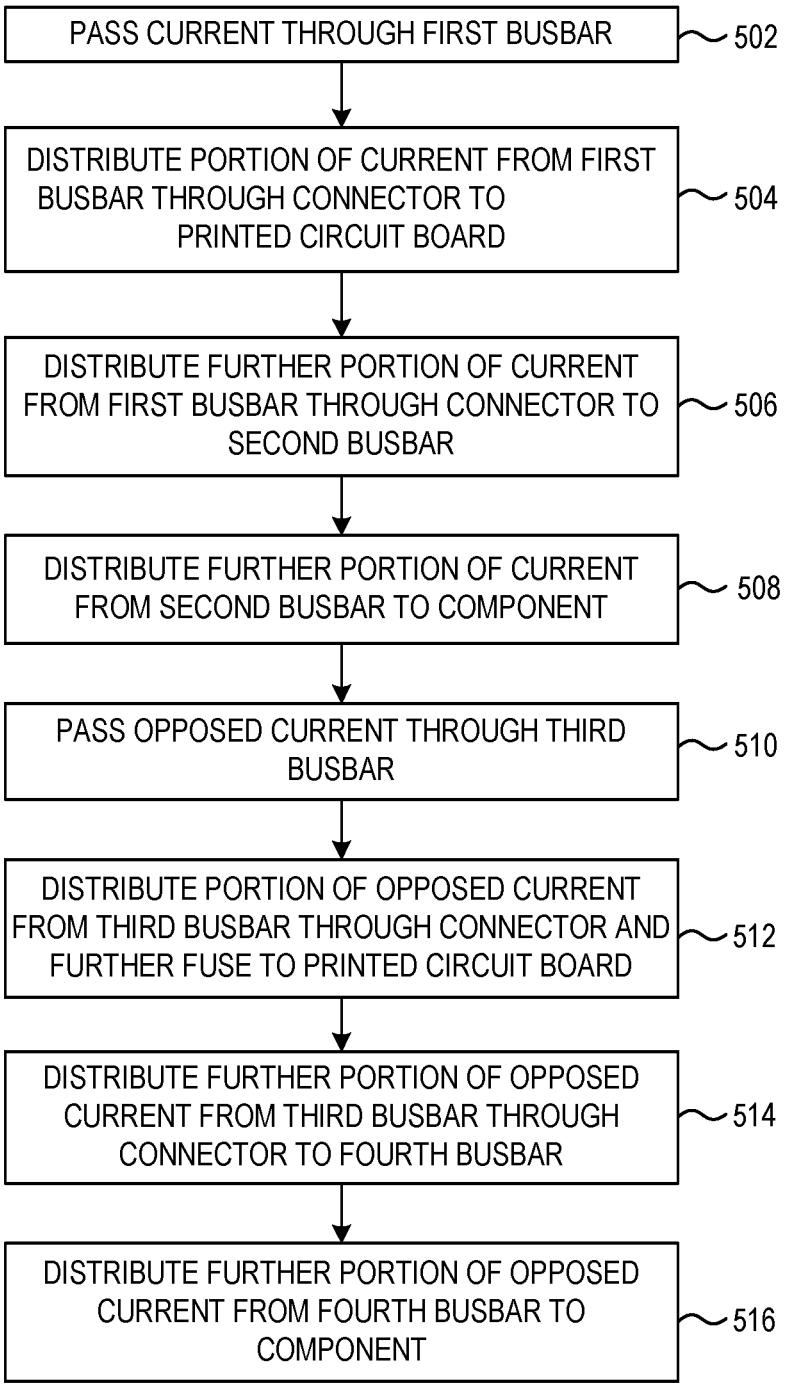
FIG. 5 is a flow diagram of a method of distributing current through a printed circuit board, busbar and connector assembly, which can be practiced by the embodiments described herein.

FIG. 5 is a flow diagram of a method of distributing current through a printed circuit board, busbar and connector assembly, which can be practiced by the embodiments described herein. For correspondence to embodiments in the drawings, FIGS. 1 and 2 show a first busbar 106 and a second busbar 110, and FIG. 1 shows a third busbar 108 and a fourth busbar 112. Numbering of busbars is arbitrary and by example only, and is readily changed for further examples. In an action 502, current is passed through a first busbar. A portion of the current from the first busbar is distributed through a connector to a printed circuit board, in an action 504. In some embodiments, the portion of the current is distributed through a connector and a fuse to the printed circuit board. A further portion of current is distributed from the first busbar through the connector to a second busbar, in an action 506. The further portion of current is distributed from the second busbar to a component, in an action 508.

An opposed current is passed through a third busbar, in an action 510 of FIG. 5. The current and the opposed current, through the first and third busbars, form balanced power and ground, in some embodiments. A portion of the opposed current from the third busbar is distributed through the connector and a further fuse to the printed circuit board, in an action 512. A further portion of the opposed current is distributed from the third busbar through the connector to a fourth busbar, in an action 514. The further portion of the opposed current is distributed from the fourth busbar to the component in an action 516. In some embodiments, the currents through the second and fourth busbars form balanced power and ground.

Detailed illustrative embodiments are disclosed herein. However, specific functional details disclosed herein are merely representative for purposes of describing embodiments. Embodiments may, however, be embodied in many alternate forms and should not be construed as limited to only the embodiments set forth herein. It should be appreciated that descriptions of direction and orientation are for convenience of interpretation, and the apparatus is not limited as to orientation with respect to gravity. In other words, the apparatus could be mounted upside down, right side up, diagonally, vertically, horizontally, etc., and the descriptions of direction and orientation are relative to portions of the apparatus itself, and not absolute.

It should be understood that although the terms first, second, etc. may be used herein to describe various steps or calculations, these steps or calculations should not be limited by these terms. These terms are only used to distinguish one step or calculation from another. For example, a first calculation could be termed a second calculation, and, similarly, a second step could be termed a first step, without departing from the scope of this disclosure. As used herein, the term "and/or" and the "/" symbol includes any and all combinations of one or more of the associated listed items.

As used herein, the singular forms "a", "an" and "the" are intended to include the plural forms as well, unless the context clearly indicates otherwise. It will be further understood that the terms "comprises", "comprising", "includes", and/or "including", when used herein, specify the presence of stated features, integers, steps, operations, elements, and/or components, but do not preclude the presence or addition of one or more other features, integers, steps, operations, elements, components, and/or groups thereof. Therefore, the terminology used herein is for the purpose of describing particular embodiments only and is not intended to be limiting.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Although the method operations were described in a specific order, it should be understood that other operations may be performed in between described operations, described operations may be adjusted so that they occur at slightly different times or the described operations may be distributed in a system which allows the occurrence of the processing operations at various intervals associated with the processing.

Various units, circuits, or other components may be described or claimed as "configured to" perform a task or tasks. In such contexts, the phrase "configured to" is used to connote structure by indicating that the units/circuits/components include structure (e.g., circuitry or mechanical features) that performs the task or tasks during operation. As such, the unit/circuit/component can be said to be configured to perform the task even when the specified unit/circuit/component is not currently operational (e.g., is not on). The units/circuits/components used with the "configured to" language include hardware—for example, circuits, memory storing program instructions executable to implement the operation, etc. Reciting that a unit/circuit/component is "configured to" perform one or more tasks is expressly intended not to invoke 35 U.S.C. 112, sixth paragraph, for that unit/circuit/component. Additionally, "configured to" can include generic structure (e.g., generic circuitry) that is manipulated by software and/or firmware (e.g., an FPGA or a general-purpose processor executing software) to operate in manner that is capable of performing the task(s) at issue. "Configured to" may also include adapting a manufacturing process (e.g., a semiconductor fabrication facility) to fabricate devices (e.g., integrated circuits or manufactured articles) that are adapted to implement or perform one or more tasks, or designing an article or apparatus to have certain features or capabilities.

The foregoing description, for the purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the embodiments and its practical applications, to thereby enable others skilled in the art to best utilize the embodiments and various modifications as may be suited to the particular use contemplated. Accordingly, the present embodiments are to be considered as illustrative and not restrictive, and the invention is not to be limited to the details given herein, but may be modified within the scope and equivalents of the appended claims.

What is claimed is:

1. A hybrid power delivery assembly, comprising:

a printed circuit board comprising a connector to couple to a first busbar;

a second busbar coupled to the connector, the second busbar external from the printed circuit board; and the connector is further to distribute a first portion of current from the first busbar to the printed circuit board and distribute a second portion of the current from the first busbar to the second busbar, wherein the first portion of the current is less than the second portion of the current.

2. The hybrid power delivery assembly of claim 1, wherein the connector comprises:

a connector tip to contact the first busbar and a third busbar and to conduct at a first voltage from the first busbar and conduct at a second voltage from the third busbar.

3. The hybrid power delivery assembly of claim 1, wherein the connector floats relative to the first busbar.

4. The hybrid power delivery assembly of claim 1, wherein the connector is further to connect to a third busbar, and connect to a fourth busbar, wherein the first busbar and the third busbar form balanced power and ground, and the second busbar and the fourth busbar further form balanced power and ground.

5. The hybrid power delivery assembly of claim 1, wherein:

ground is distributed through a plurality of ground planes of the printed circuit board; and power is distributed through the first busbar and the second busbar.

6. The hybrid power delivery of claim 1, wherein the printed circuit board comprises electronic circuitry for one or more network switches.

7. A busbar and connector assembly, comprising:

a first busbar to propagate a first current;

a printed circuit board;

a second busbar external to the printed circuit board; and a connector coupled to the printed circuit board, the first busbar and the second busbar, the connector to deliver a portion of the first current to the printed circuit board and deliver a remaining portion of the first current to the second busbar, wherein the portion of the first current is less than the remaining portion of the first current.

8. The busbar and connector assembly of claim 7, further comprising:

a third busbar, parallel to the first busbar, with an entirety of a connector tip of the connector located between the first busbar and the third busbar, the connector tip having a first finger to contact the first busbar at a first voltage and the connector tip having a second finger to contact the third busbar at a third voltage.

9. The, busbar and connector assembly of claim 7, wherein the connector floats relative to the first busbar.

10. The busbar and connector assembly of claim 7, wherein the connector is coupled to a surface of the printed circuit board through pins extending from a first surface of the connector into holes on the surface of the printed circuit board and wherein the second busbar extends from a second surface of the connector and the second busbar extends along a plane parallel to the surface of the printed circuit board.

11. The busbar and connector assembly of claim 7, wherein:

the printed circuit board powers at least a first component of a network switch; and the second busbar powers at least a second component of the network switch.

12. A method of distributing current through a printed circuit board, busbar and connector assembly, comprising:

passing the current through a first busbar;

distributing a first portion of the current from the first busbar through a connector, to a printed circuit board; and distributing a second portion of the current from the first busbar through the connector, to a second busbar, wherein the wherein the first portion of the current is less than the second portion of the current.

13. The method of claim 12, wherein the distributing the first and second portions of the current from the first busbar is with an entirety of a connector tip of the connector located between the first busbar and a third busbar.

14. The method of claim 12, wherein the distributing the first and second portions of the current from the first busbar through the connector is with the connector floating relative to the first busbar.

15. The method of claim 12, further comprising:

passing an opposed current through a third busbar;

distributing a third portion of the opposed current from the third busbar through the connector, to the printed circuit board; and distributing a fourth portion of the opposed current from the third busbar through the connector, to a fourth busbar, wherein the current and the opposed current, the first portion of the current and the third portion of the opposed current, and the second portion of the current and the fourth portion of the opposed current, form balanced power and ground currents.

16. The method of claim 12, further comprising:

distributing ground through a plurality of ground planes of the printed circuit board; and distributing power through the first busbar and the second busbar.

17. The method of claim 12, wherein:

the distributing the first portion of the current to the printed circuit board comprises distributing the first portion of the current to a printed circuit board of a network switch; and the distributing the second portion of the current to the second busbar comprises distributing the second portion of the current through the second busbar to one or more fans to cool the printed circuit board of the network switch.

18. A power delivery apparatus, comprising:

a connector to distribute a first portion of current received from a first busbar to a printed circuit board and distribute a second portion of the current from the first busbar to a second busbar external to the printed circuit board, wherein the connector is configurable so that distribution of an amount of the first portion of the current ranges from no current to less than all the current.

19. The power delivery apparatus of claim 18 wherein the connector floats relative to the first busbar.

20. The power delivery apparatus of claim 18 wherein a connector tip of the connector is located between the first busbar and a third busbar.

21. The power delivery apparatus of claim 18 wherein the connector is coupled to a surface of the printed circuit board through pins extending from a first surface of the connector into holes on the surface of the printed circuit board.

* * * * *